US006553781B2

(12) United States Patent
Taylor

(10) Patent No.: US 6,553,781 B2
(45) Date of Patent: Apr. 29, 2003

(54) CRYOGENIC TUNNEL FOR CHILLING PRODUCTS, ESPECIALLY FOOD PRODUCTS

(75) Inventor: Robert Taylor, Wavre (BE)

(73) Assignee: L'Air Liquide Societe Anonyme a Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/941,605

(22) Filed: Aug. 30, 2001

(65) Prior Publication Data

US 2002/0029582 A1 Mar. 14, 2002

(30) Foreign Application Priority Data

Sep. 1, 2000 (FR) ..... 00 11189

(51) Int. Cl.[7] ..... F25D 25/04
(52) U.S. Cl. ..... 62/380
(58) Field of Search ..... 62/378, 380, 374, 62/63, 62

(56) References Cited

U.S. PATENT DOCUMENTS 3,302,423 A 2/1967 Morrison
3,533,245 A 10/1970 Komberec et al.
3,914,953 A 10/1975 Miller
4,947,654 A 8/1990 Sink et al.
5,353,719 A * 10/1994 Eshleman et al. ..... 110/188
5,567,151 A * 10/1996 Mizoguchi et al. ..... 432/145
5,968,578 A 10/1999 Knisely
6,115,237 A * 9/2000 Zahorsky et al. ..... 361/679

FOREIGN PATENT DOCUMENTS

EP 0 058 782 A1 1/1982
GB 2 168 588 A 6/1986

OTHER PUBLICATIONS

Search Report issued in application No. FR 00 11189.

* cited by examiner

*Primary Examiner*—William C. Doerrler
*Assistant Examiner*—Malik N. Drake
(74) *Attorney, Agent, or Firm*—Burns, Doane, Swecker & Mathis, L.L.P.

(57) ABSTRACT

Cryogenic tunnel for chilling products, especially food products, comprising a horizontal conveyor belt (1) for products and means for blowing a cold gas thereover and for limiting the escape of cold gas from the tunnel and/or the admission of external gas into the tunnel. The tunnel comprises at least one fan (2) placed above the conveyor belt, the blades of which extend transversely with respect to the belt over virtually the entire width thereof.

23 Claims, 1 Drawing Sheet

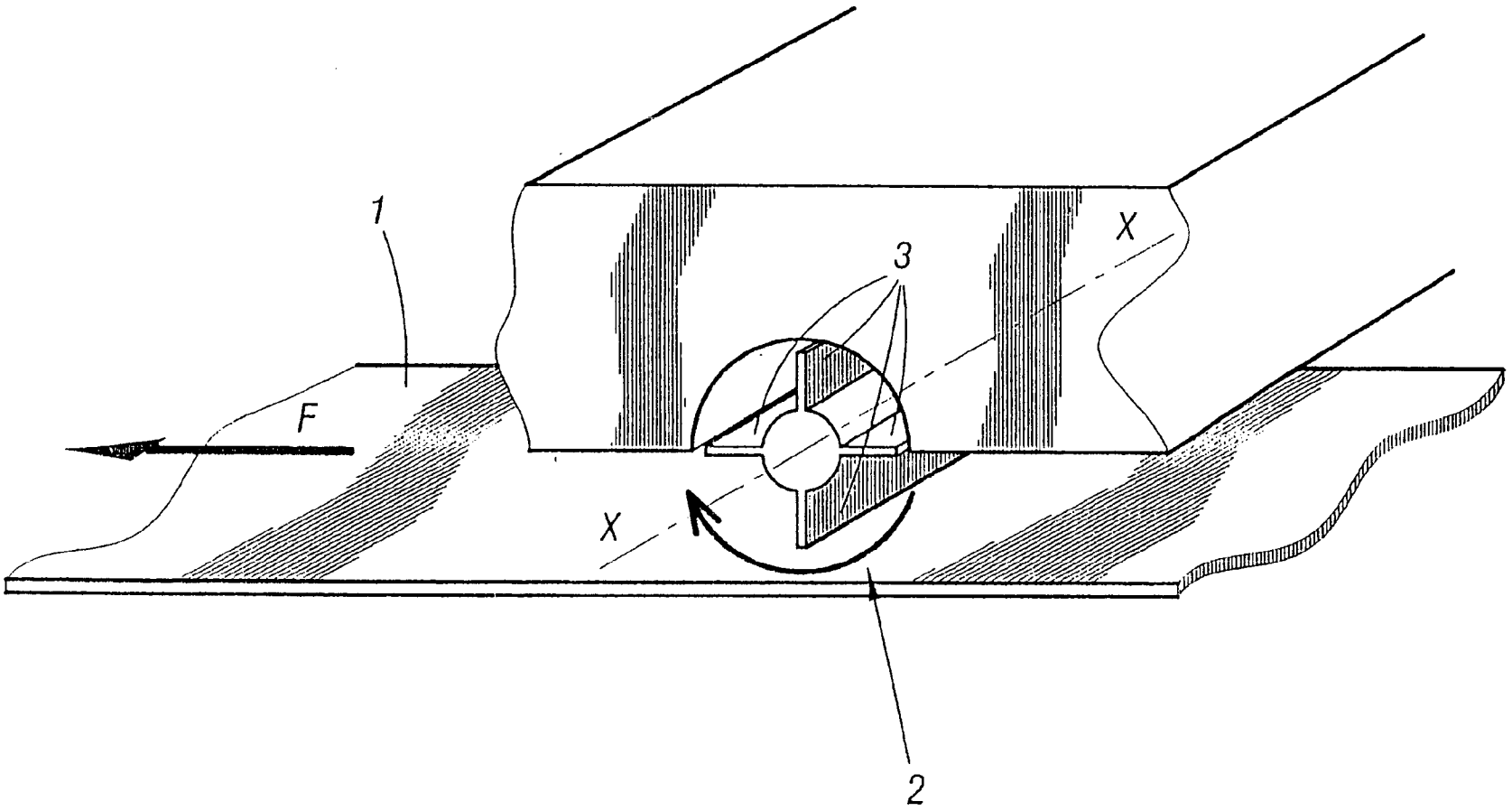
1
F
X
3
X
2

CRYOGENIC TUNNEL FOR CHILLING PRODUCTS, ESPECIALLY FOOD PRODUCTS

BACKGROUND OF THE INVENTION

1. Field of the Invention

The subject of the present invention is a cryogenic tunnel for chilling products, especially food products.

2. Description of the Related Art

Tunnels of this type generally comprise a horizontal conveyor belt for the products and means for blowing a cold gas thereover and for limiting the escape of cold gas from the tunnel and/or the admission of external gas into the tunnel.

This is because it is necessary to prevent the natural escape of cold gas from the tunnel and therefore to direct the cold air back into the tunnel, in order to recover heat transfer energy.

The purpose of this recirculation of cold air is therefore to improve the heat transfer coefficient, but without having to add excessive mechanical energy to the gas flow system. This is because it is important that the lightweight products moving on the conveyor belt cannot be deflected from their paths by employing these means to redirect the cold gas. Finally, it is also necessary to prevent the formation of ice in the tunnel, which could be caused by the ingress of moist external air mixing in the tunnel with the escaping cold air. Such ice formation is undesirable since it increases the energy consumption needed.

It is therefore important to prevent the entry of moist air from outside the tunnel.

To solve this problem various solutions have hitherto been proposed, especially the following: inclining the tunnel in order to help the cold, heavy air to move under gravity in a controlled direction, the use of gas deflector plates or louvers opposite fans, the use of centrifugal blowers and pipes to suck up the gas and blow it in the desired direction, these devices being made bidirectional by employing mechanical baffles. The systems which have turned out to be the most satisfactory are centrifugal blowers, but they have the drawback of tending to move the lightweight products on the conveyor belt. Furthermore, they produce localised variations in flow and are difficult to clean.

SUMMARY OF THE INVENTION

The object of the invention is therefore to fit the cryogenic tunnel with means for controlling the flow of cold gas which do not have these drawbacks.

In accordance with the invention, the cryogenic tunnel comprises at least one fan placed above the conveyor belt, the blades of which extend transversely with respect to the belt over virtually the entire width thereof.

According to one preferred embodiment, the fan has two to six radial blades whose axis of rotation is virtually perpendicular to the longitudinal direction of progression of the belt and parallel thereto.

Thus the fan is fitted with a small number of blades, but they extend over practically the entire width of the belt, and rotate at a suitable speed so that excess energy is not dissipated over the moving products. Cold gas is thus gently moved over the entire surface of the belt, without any strong sucking or strong blowing region which could cause undesirable swirls of the hot or cold gas, or cause movements of the products on the belt. This fan creates an increased heat transfer region by the action of its vanes and effectively opposes the escape of cold gas from the tunnel.

The tunnel may comprise one or more of the following characteristics:

- the fan has radial blades whose axis of rotation is virtually perpendicular to the longitudinal direction of progression of the belt and parallel thereto;
- the fan has two to six blades;
- the tunnel comprises means of reversing the direction of rotation of the fan;
- the tunnel comprises means of varying the speed of rotation of the fan;
- the tunnel comprises at least two fans as defined, placed in longitudinally spaced-out positions in the tunnel;
- each fan is placed close to one end of the tunnel.

BRIEF DESCRIPTION OF THE DRAWING

The invention will now be described with reference to the appended drawing which illustrates one embodiment thereof by way of nonlimiting example.

The single FIGURE is a schematic perspective view of a fan placed above a conveyor belt of a cryogenic tunnel according to the invention.

The cryogenic tunnel partially shown in the drawing is intended for the chilling of products, especially food products (not shown).

This tunnel comprises a horizontal conveyor belt 1 supporting the products to be chilled, driven in a manner known per se by means not shown. The tunnel comprises two fans 2, one of which has been shown in the drawing, these being placed above the conveyor belt 1 at appropriate longitudinally spaced-out positions, for example at the opposite ends of the tunnel. Each fan 2 extends transversely over virtually the entire width of the belt 1 and has a small number of radial blades or vanes 3, i.e. four in the exemplary embodiment shown. This number may vary, there being preferably between two and six thereof.

The axis of rotation XX of the blades 3 of the fan 2 is virtually perpendicular to the longitudinal direction F of progression of the belt 1 and parallel thereto. Since the longitudinal direction F of progression of the belt is oriented towards the left in the appended figure, each fan 2 rotates about the axis XX in the clockwise direction, i.e. each fan blows cold gas over the products placed on the belt 1 in their direction of progression F, i.e. as a cocurrent.

The speed of rotation of each fan 2 is suitably adjusted, for example by means of a variable speed drive, so that it does not generate too much energy, in particular to avoid moving lightweight products on the belt 1. This rate of rotation is set so that the corresponding blowing energy is very much below that of the centrifugal blowers used in the prior art.

The direction of rotation of each fan may be reversed. In particular, the downstream fan may blow as a cocurrent while the upstream fan rotates in the opposite direction in order to help keep the tunnel free from any undesirable ingress of air during periods of low production. The speed of rotation of the fans 2 may be automatically regulated, for example by means of a system for controlling the temperature at the tunnel outlet.

The fans 2 may be placed inside covers suitably mounted in the tunnel; it is also possible for them to have a hollow cylindrical sector shape, especially a semi-cylindrical shape, the upper part of the tunnel being thermally insulating in order to partially house the fans, especially their upper half. The corresponding section of the tunnel may form a heat expansion contraction joint.

What is claimed is:

1. Cryogenic tunnel for chilling products, comprising a horizontal conveyor belt for the products, means for blowing a cold gas over the products and for limiting the escape of cold gas from the tunnel and/or the admission of external gas into the tunnel, wherein said means comprises at least one fan placed above the conveyor belt, the blades of which extend transversely with respect to the belt over virtually the entire width thereof.

2. Tunnel according to claim 1, wherein the fan has radial blades whose axis of rotation is virtually perpendicular to the longitudinal direction of progression of the belt and parallel to the belt.

3. Tunnel according to claim 2, wherein the fan has two to six blades.

4. Tunnel according to claim 2, wherein it comprises means of reversing the direction of rotation of the fan.

5. Tunnel according to claim 2, wherein it comprises means of varying the speed of rotation of the fan.

6. Tunnel according to claim 2, wherein it comprises at least two fans as defined, placed in longitudinally spaced-out positions in the tunnel.

7. Tunnel according to claim 2, wherein each fan is placed close to one end of the tunnel.

8. Tunnel according to claim 1, wherein the fan has two to six blades.

9. Tunnel according to claim 8, wherein it comprises means of reversing the direction of rotation of the fan.

10. Tunnel according to claim 8, wherein it comprises means of varying the speed of rotation of the fan.

11. Tunnel according to claim 8, wherein it comprises at least two fans as defined, placed in longitudinally spaced-out positions in the tunnel.

12. Tunnel according to claim 8, wherein each fan is placed close to one end of the tunnel.

13. Tunnel according to claim 1, wherein it comprises means of reversing the direction of rotation of the fan.

14. Tunnel according to claim 13, wherein it comprises means of varying the speed of rotation of the fan.

15. Tunnel according to claim 13, wherein it comprises at least two fans as defined, placed in longitudinally spaced-out positions in the tunnel.

16. Tunnel according to claim 13, wherein each fan is placed close to one end of the tunnel.

17. Tunnel according to claim 1, wherein it comprises means of varying the speed of rotation of the fan.

18. Tunnel according to claim 17, wherein it comprises at least two fans as defined, placed in longitudinally spaced-out positions in the tunnel.

19. Tunnel according to claim 17, wherein each fan is placed close to one end of the tunnel.

20. Tunnel according to claim 1, wherein it comprises at least two fans as defined, placed in longitudinally spaced-out positions in the tunnel.

21. Tunnel according to claim 20, wherein each fan is placed close to one end of the tunnel.

22. Tunnel according to claim 1, wherein each fan is placed close to one end of the tunnel.

23. Tunnel according to claim 1, wherein the products comprise food products.

* * * * *